US007278593B2

(12) United States Patent
Wang et al.

(10) Patent No.: US 7,278,593 B2
(45) Date of Patent: Oct. 9, 2007

(54) COMMON RAIL FUEL INJECTOR

(75) Inventors: Yongxin Wang, Bloomington, IL (US); Ye Tian, Bloomington, IL (US); Norman D. Knapp, Roanoke, IL (US); Norval J. Wiemken, Dwight, IL (US)

(73) Assignee: Caterpillar Inc., Peoria, IL (US)

( * ) Notice: Subject to any disclaimer, the term of this patent is extended or adjusted under 35 U.S.C. 154(b) by 476 days.

(21) Appl. No.: 10/600,877

(22) Filed: Jun. 20, 2003

(65) Prior Publication Data

US 2004/0056117 A1 Mar. 25, 2004

Related U.S. Application Data

(60) Provisional application No. 60/413,403, filed on Sep. 25, 2002.

(51) Int. Cl.

| | |
|---|---|
| ***F02M 59/00*** | (2006.01) |
| ***F02M 61/00*** | (2006.01) |
| ***F02M 63/00*** | (2006.01) |
| *F02D 1/06* | (2006.01) |
| *F02D 7/00* | (2006.01) |

(52) U.S. Cl. ..... 239/533.2; 239/533.15; 239/533.9; 239/585.1; 239/585.5; 239/88; 239/94; 239/96; 251/129.1; 335/266; 335/267; 335/268

(58) Field of Classification Search ..... 239/585.1, 239/533.2, 585.2–585.5, 88, 94, 96; 251/129.1; 335/232, 266–268

See application file for complete search history.

(56) References Cited

U.S. PATENT DOCUMENTS 4,627,571 A 12/1986 Kato et al.

(Continued)

FOREIGN PATENT DOCUMENTS

DE 4332119 A1 3/1995

(Continued)

OTHER PUBLICATIONS

J. Hlousek, Electronically Controlled Fuel Injection Systems for Medium Speed Diesel Engines, Bosch, Electronic Diesel and Gasoline Fuel Injection Technology, Aug. 1998, pp. 1-13.

(Continued)

*Primary Examiner*—Dinh Q. Nguyen
*Assistant Examiner*—James S. Hogan
(74) *Attorney, Agent, or Firm*—Liell & McNeil

(57) ABSTRACT

A common rail fuel injector comprises a three-way control valve that controls the flow of high-pressure fuel to a fuel cavity for fuel injection. Specifically, when the control valve is transitioning to a first, on position, from a second, off position, high-pressure fuel is provided to both the fuel cavity and to a check control cavity, thereby preventing fuel injection until the control valve seats in the first, on position. Once seated in the first, on position, the control valve only provides high-pressure fuel to the fuel cavity allowing fuel injection to occur. To stop injection, the control valve is moved from the first, on position to the second, closed position. Once again, while the control valve is in the transition location between the two positions, high-pressure fuel is provided to both the fuel cavity and to the check control cavity thereby terminating injection. Once the control valve is seated back in the second, closed position, the fuel cavity and the check control cavity are fluidly connected.

17 Claims, 5 Drawing Sheets

U.S. PATENT DOCUMENTS

| | | | | |
|---|---|---|---|---|
| 4,826,080 | A | 5/1989 | Ganser | |
| 5,038,826 | A | 8/1991 | Kabai et al. | |
| 5,125,575 | A | 6/1992 | Iwanaga | |
| 5,156,132 | A | 10/1992 | Iwanaga | |
| 5,263,645 | A | 11/1993 | Paul et al. | |
| 5,397,055 | A | 3/1995 | Paul et al. | |
| 5,538,187 | A | 7/1996 | Mueller et al. | |
| 5,664,545 | A | 9/1997 | Kato et al. | |
| 5,832,899 | A | 11/1998 | Soteriou | |
| 5,941,215 | A | 8/1999 | Augustin | |
| 5,984,200 | A * | 11/1999 | Augustin | 239/88 |
| 5,992,767 | A | 11/1999 | Phillips et al. | |
| 6,027,047 | A * | 2/2000 | Augustin | 239/533.3 |
| 6,199,533 | B1 | 3/2001 | Morris et al. | |
| 6,247,452 | B1 | 6/2001 | Dittus et al. | |
| 6,264,116 | B1 * | 7/2001 | Harcombe et al. | 239/124 |
| 6,267,306 | B1 * | 7/2001 | Phillips et al. | 239/585.1 |
| 6,360,721 | B1 * | 3/2002 | Schuricht et al. | 123/446 |
| 6,382,189 | B1 | 5/2002 | Hlousek | |
| 6,422,211 | B1 | 7/2002 | Boecking | |
| 6,431,148 | B1 | 8/2002 | Guggenbichler et al. | |
| 6,532,943 | B1 * | 3/2003 | Yudanov | 123/502 |
| 6,565,013 | B1 | 5/2003 | Buergler et al. | |
| 6,647,966 | B2 | 11/2003 | Tian et al. | |
| 6,679,440 | B2 * | 1/2004 | Igashira et al. | 239/533.2 |
| 6,705,551 | B1 | 3/2004 | Kienzler et al. | |
| 6,745,952 | B1 | 6/2004 | Hlousek | |
| 6,837,450 | B2 * | 1/2005 | Boecking | 239/533.2 |
| 6,843,464 | B2 | 1/2005 | Stoecklein et al. | |
| 2002/0043569 | A1 | 4/2002 | Boecking | |
| 2002/0134853 | A1 | 9/2002 | Stoecklein et al. | |
| 2003/0019959 | A1 | 1/2003 | Brenk et al. | |
| 2004/0011331 | A1 | 1/2004 | Brocco et al. | |

FOREIGN PATENT DOCUMENTS

| | | | |
|---|---|---|---|
| EP | 1 036 931 | A2 | 9/2000 |
| EP | 1 143 139 | A1 | 10/2001 |
| EP | 1 199 467 | A2 | 4/2002 |
| WO | WO93/23667 | | 11/1993 |
| WO | WO95/21998 | | 8/1995 |
| WO | 1 079 096 | A2 | 2/2001 |
| WO | WO 01/14713 | A1 | 3/2001 |
| WO | 00/55490 | | 9/2002 |

OTHER PUBLICATIONS

J. Hlousek, Common Rail Fuel Injection System For High Speed Large Siesel Engines, Robert Bosch AG, Fuel Injection Equipment Large Diesels, 1998, pp. 1238-1251, Copenhagen.

* cited by examiner

COMMON RAIL FUEL INJECTOR

This application claims benefit to Provisional application No. 60/413,403, filed on Sep. 25, 2002.

TECHNICAL FIELD

The present invention is related to common rail fuel injectors and more specifically to controlling the flow of high-pressure fuel within the injector.

BACKGROUND

As emission requirements continue to become more stringent, engine manufacturers and component suppliers continue to improve engine operation. One area that has received particular focus has been fuel injection. By more accurately controlling fuel injection, improved combustion can be achieved, providing better engine efficiency and reduced emissions.

One type of fuel injector that has received much attention has been the common rail injector. The common rail fuel injector controls the injection of high-pressure fuel that the injector receives from a high-pressure fuel rail. The injector does not pressurize the fuel but simply controls injection by controlling the check valve. Typically, high-pressure fuel is constantly present in the tip of the fuel injector and injection occurs by actuating a control valve to vent a check control cavity, allowing the high-pressure fuel in the tip to push the check valve up.

Although the common rail injector provides good control of fuel injection, improvement is still necessary. Specifically, the common rail injector has limited rate-shaping capability, generally a square rate shape, due to the fact that high-pressure fuel is always present in the tip. Further, the common rail fuel injector's delivery curve is not linear and can have unusable ranges because fuel injection starts as soon as the control valve is actuated, as opposed to waiting until the control valve is seated.

Furthermore, leakage of high-pressure fuel within the injector contributes to losses and less than optimal system efficiency, as such leakage requires the pump to pressurize such fuel, yet the system does not benefit from the fuel which leaks.

The constant presence of high-pressure fuel in the tip of such common rail injectors is also seen as a potential source of engine damage, should the nozzle needle remain in an open or partially-open position. One way to address this concern is changing the internal plumbing arrangement of the injector's valves and lines to form an admission valve. Such admission valves only allow high pressure fuel to be present in the tip only when injection is desired, rather these valves block the high pressure from reaching the tip during the non-injection period and vent any pressure remaining in the tip at the end of injection back to tank. Typical common rail injectors in production today utilize a 3-port, 2-position valve, and do not block the fuel from reaching the tip during the non-injection period.

Some admission valves are described as a control slide, or spool valves, whose control edges meter the fuel quantity to be delivered, and even attempt to limit leakage losses by closing the outlet side opening before opening the inlet side opening. However such spool valves must have diametral clearance to move, and such clearance forms a leakage path that contributes to losses.

An exemplary admission valve is shown in U.S. Pat. No. 5,538,187. This admission valve improves the control valve by forming a poppet valve rather than a spool valve. Such valves are known to seal better than spool valves, and therefore have lower leakage losses. The other end forms a flat valve seat, which are known to be difficult to achieve a tight seal, versus that possible with a poppet valve.

The present application addresses one or more of the problems identified above.

SUMMARY OF THE INVENTION

In one embodiment the fuel injector has a high pressure fuel supply, fuel cavity, a check control cavity, check valve at least partially disposed in the fuel cavity and being exposable to a fluid pressure force from the check control cavity, a control valve movable between a first position in which high pressure fuel supply is fluidly connected to the fuel cavity and a second position in which the fuel cavity is fluidly connected to the check control cavity, and a low pressure drain line directly connected to said check control cavity.

In another embodiment a method of operating a fuel injector having a fuel cavity, check control cavity, and a check valve at least partially slideably disposed in the fuel cavity and exposable to pressure force in said check control cavity comprises actuating a control valve, fluidly connecting the fuel cavity to the check control cavity, and stopping fuel injection.

In another embodiment a method of operating a fuel injector having a fuel cavity, check control cavity, and a check valve at least partially slideably disposed in said fuel cavity and exposable to pressure force in said check control cavity and a control valve movable between a first position in which high pressure fuel flows from high pressure fuel source to the fuel cavity and a second position in which high pressure fuel source is fluidly blocked from the fuel cavity comprises; moving the control valve from a second position to the first position and fluidly connecting fuel cavity and the check control cavity to the high pressure fuel source while the control valve is in the transition location.

DETAILED DESCRIPTION

Figure 1:
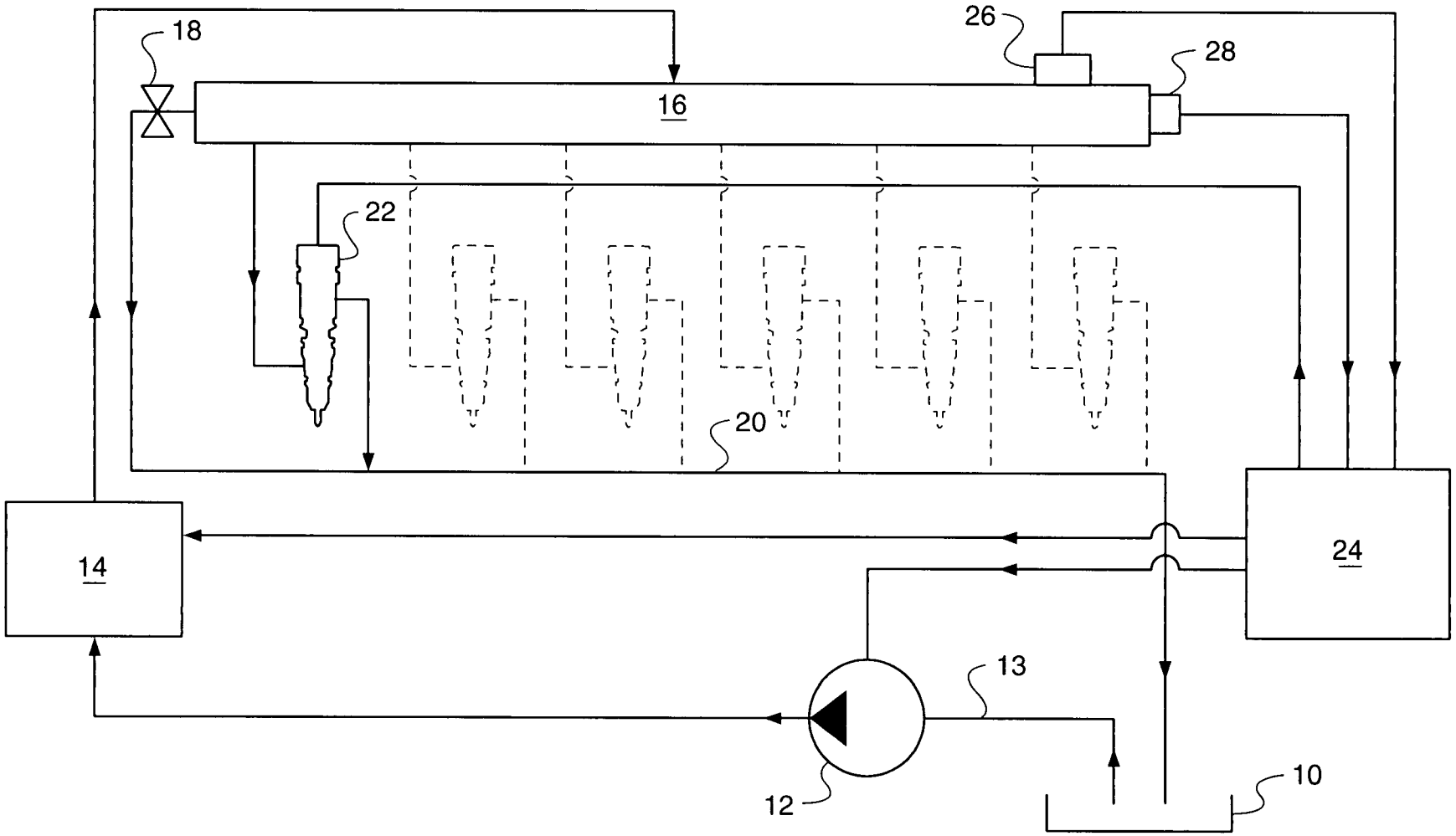
FIG. 1 is a diagrammatic schematic of a fuel system using a common rail fuel injector.

Referring to FIG. 1, a fuel system utilizing a common rail fuel injector 22 is shown. A reservoir 10 contains fuel at a ambient pressure. A transfer pump 12 draws low-pressure fuel through fuel supply line 13 and provides it to high-pressure pump 14. High-pressure pump 14 then pressurizes the fuel to desired fuel injection pressure levels and delivers the fuel to fuel rail 16. The pressure in fuel rail 16 is controlled in part by safety valve 18, which spills fuel to the fuel return line 20 if the pressure in rail 16 is above a desired pressure. The fuel return line 20 returns fuel to low-pressure reservoir 10.

Fuel injector 22 draws fuel from rail 16 and injects it into a combustion cylinder of the engine (not shown). Fuel not injected by injector 22 is spilled to fuel return line 20. Electronic Control Module (ECM) 24 provides general control for the system. ECM 24 receives various input signals, such as from pressure sensor 26 and a temperature sensor 28 connected to fuel rail 16, to determine operational conditions. ECM 24 then sends out various control signals to various components including the transfer pump 12, high-pressure pump 14, and fuel injector 22.

Figure 2:
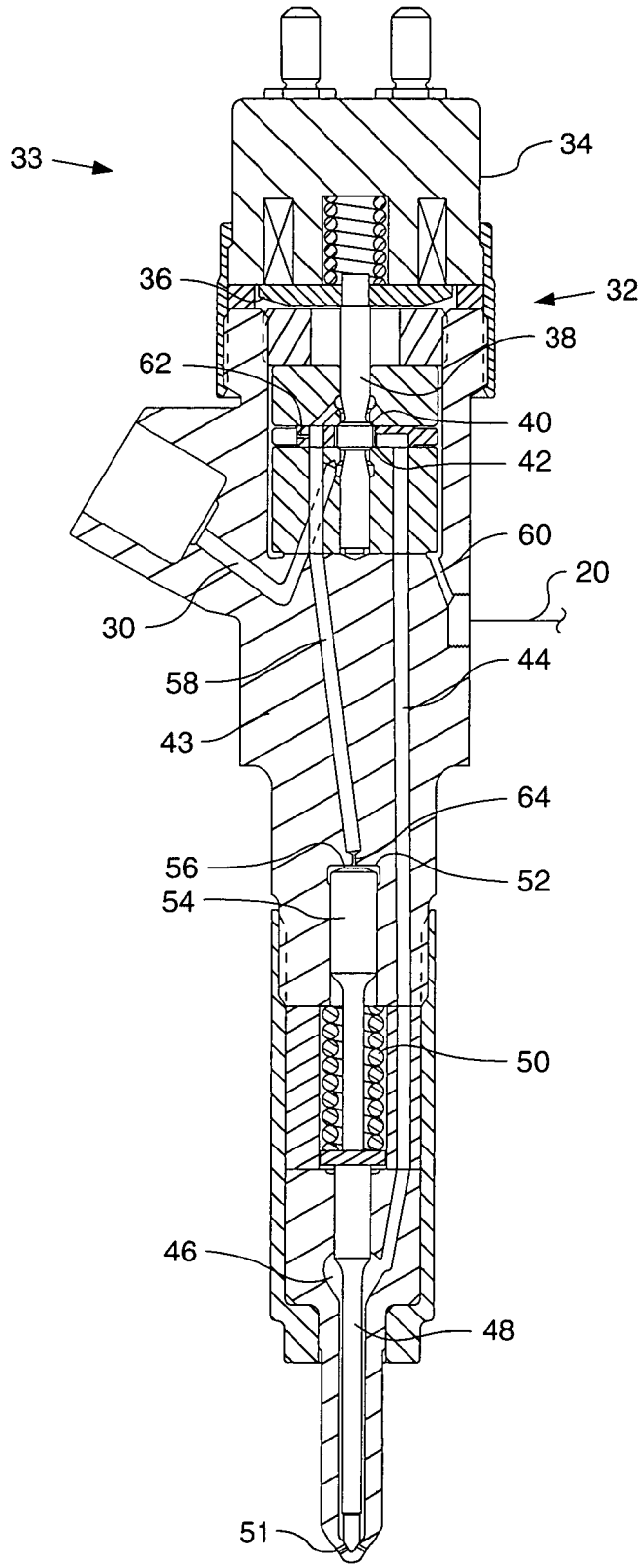
FIG. 2 is a diagrammatic cross section of a fuel injector according to one embodiment of the present invention.
Figure 3:
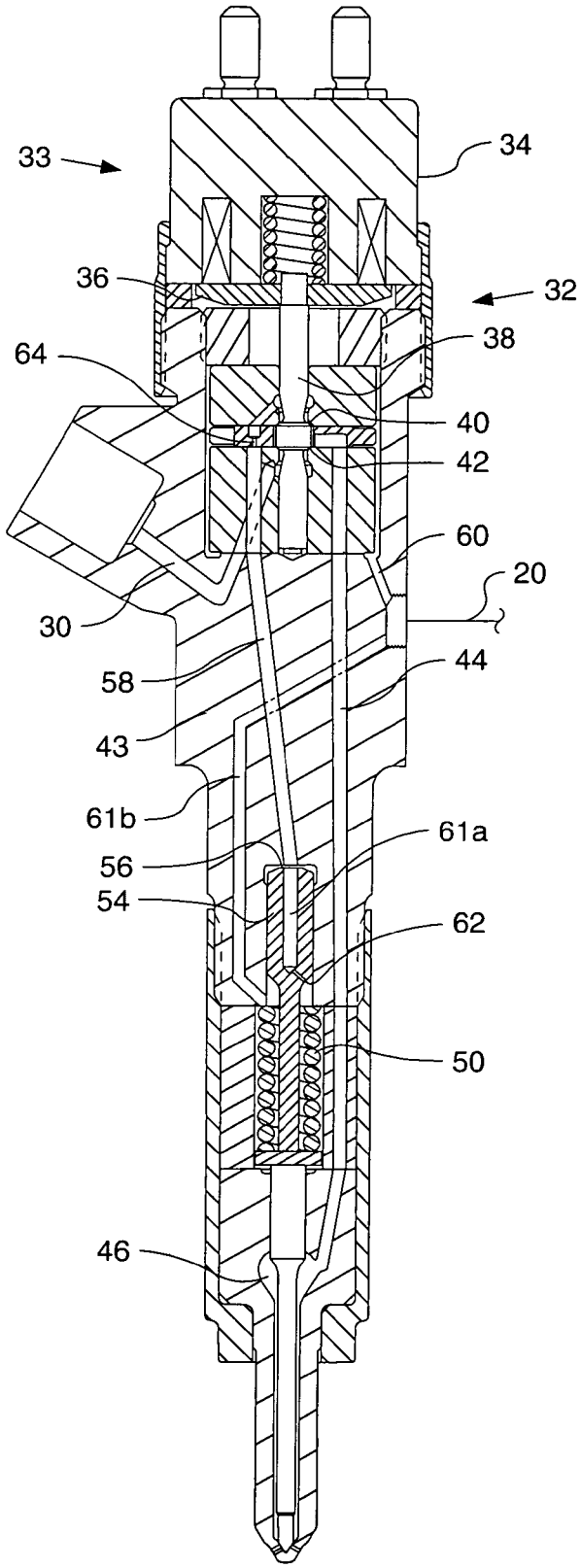
FIG. 3 is a diagrammatic cross section of a fuel injector according to one embodiment of the present invention.
Figure 4:
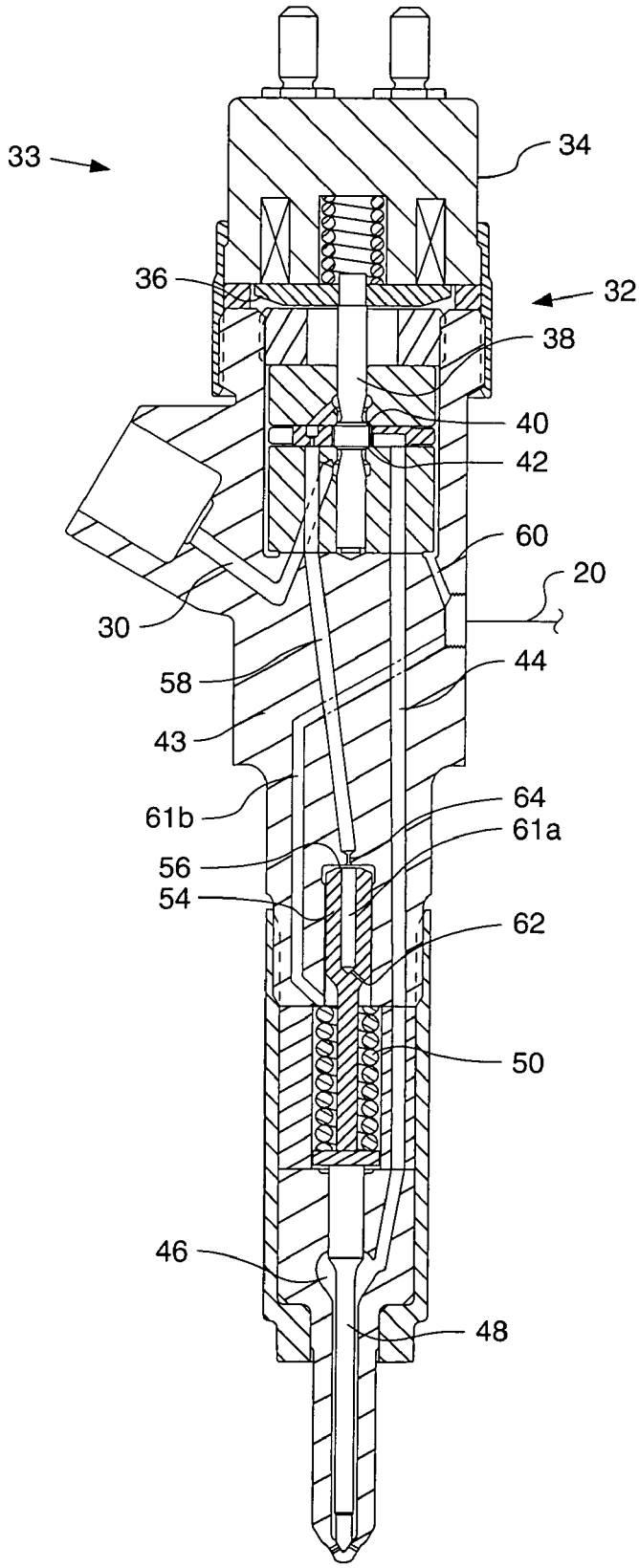
FIG. 4 is a diagrammatic cross section of a fuel injector according to still another embodiment of the present invention.
Figure 5:
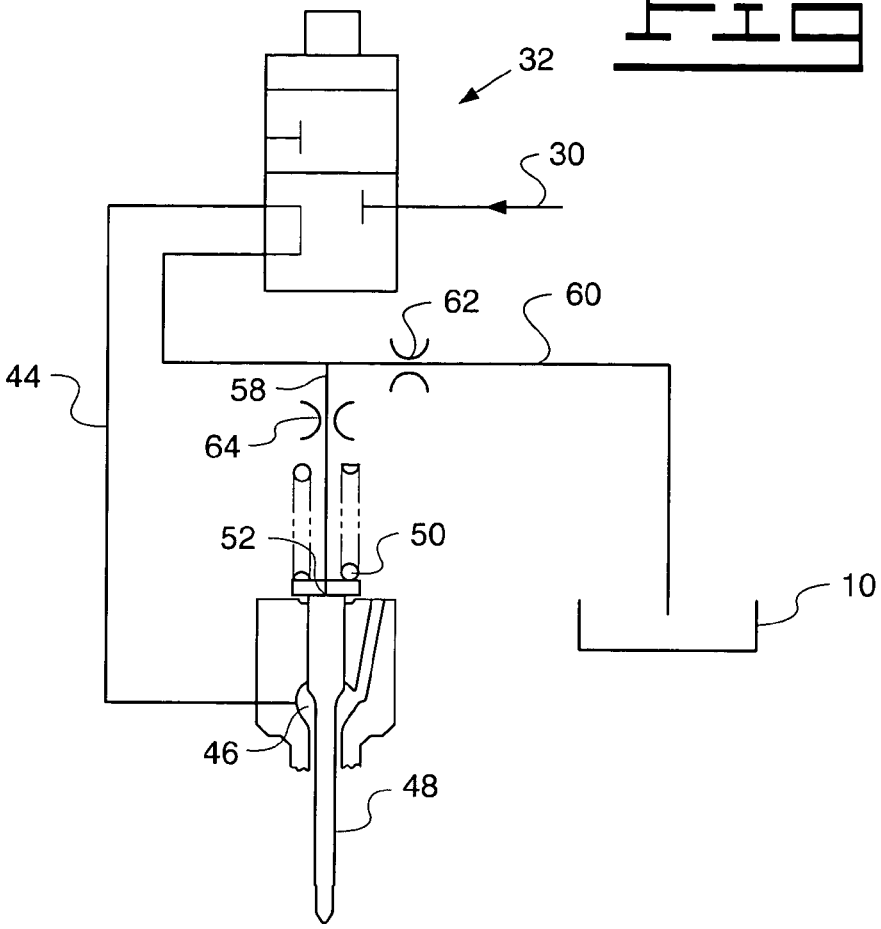
FIG. 5 is a diagrammatic schematic of a fuel injector according to one embodiment of the present invention.

Reference is now made to FIGS. 2 thru 5. High-pressure fuel enters the injector through high-pressure fuel supply 30 and travels to control valve 32. Control valve 32 includes an electrical actuator, such as a piezo or a solenoid (as illustrated in FIGS. 2 through 4). Valve member 38 is movable in response to electrical actuator movement. Solenoid 34 controls the position of armature 36, which is attached to valve member 38. Valve member 38 moves between upper seat 40 and lower seat 42 to control the flow of fuel from the high-pressure fuel line 30 to check line 44. Although control valve 32 is shown as a poppet valve, other valve types, including spool valves, or combinations of various types of valves, etc, could be used.

High-pressure fuel in check line 44 travels through body 43 to fuel cavity 46 where it acts upon check 48 to push it in an upward direction against the biasing of check spring 50. When check 48 moves upwards, fuel exits injector 22 through at least one tip orifice 51.

The opening and closing of check 48 is controlled in part by the presence of high-pressure fuel in check line 44 and by the valve opening pressure created by check spring 50. Additionally, a check control cavity 52 exists on top of the check, and specifically on top of check piston 54, to control the opening of check valve 48. When the top surface 56 of check piston 54 is exposed to pressure in check control cavity 52, a force is exerted on check valve 48 biasing it in a closed position. The area of the top surface 56 exposed to fluid pressure from check control cavity 52 is generally larger than the area of check valve 48 exposed to fluid pressure in fuel cavity 46, thereby biasing check valve 48 in the closed position. It should be noted that various check designs are possible. A single piece check could be used or a multiple piece check could be used. Further, a check piston 54, as illustrated in FIGS. 2 thru 4 could be implemented. The key is having the check control cavity 52 provide a pressure force to bias check valve 48 in the closed position.

Pressurized fluid is provided to the check control cavity 52 through check control cavity line 58. Check control cavity 52 is always fluidly connected to low-pressure drain line 60. An orifice 62 in low-pressure drain line 60 provides a flow restriction causing flow to "back up" into check control cavity line 58, thereby pressurizing check control cavity 52 when a pressurized flow is present. A second orifice 64 can be provided in the check control cavity line 58 to regulate the flow of fluid into check control cavity 52. However, it should be noted that orifice 62 and second orifice 64 must be sized appropriately to achieve the desired flow; for example, if orifice 62 was too large compared to second orifice 64, flow would not "back up" and instead drain out just low-pressure drain line 60 to reservoir 10. Focusing particularly on control valve 32, the actuation of control valve 32 controls when injector 22 will inject. Specifically, control valve 32 controls the flow of high-pressure fuel from high-pressure fuel supply line 30 to check line 44. Further, it controls the venting of check line 44 and fuel cavity 46 when injection is over allowing check spring 50 to push check valve 48 closed. Furthermore, when control valve 32 stops injection it connects check line 44 to check control cavity line 58 and the low-pressure drain line 60. By doing so, the high-pressure fluid in check line 44 vents through control valve 32 to check control cavity 52 helping apply pressure on top of a check to ensure quicker closing. Additionally, when control valve 32 is transitioning between the open and closed position, such that the valve member 38 is between the upper seat 40 and the lower seat 42, high-pressure fuel supply line 30 actually provides high-pressure flow to both check line 44 and to check control cavity line 58. This results in high-pressure fuel being present in the both the fuel cavity 46 and the check control cavity 52. By pressurizing both ends of the check, the sum of the pressure forces and spring force is in the downward direction to hold the check in the closed position until the valve member 38 reaches the upper seat 40, which then places the injector into injection mode. (Note the control valve 32 in FIG. 5 does not illustrate the function of the valve while it is transitioning from one position to another as described in detail above).

Referring to FIGS. 3 and 4, other embodiments of the present invention are shown where the low-pressure drain line 60 has been moved from the control valve to the check piston 54 and body 43. In contrast to FIG. 2, the low-pressure drain line is shown as two segments 61*a* and 61*b*, where low-pressure drain line segment A 61*a* is a passage in the check piston 54, and low-pressure drain line segment B 61*b* is a passage in the body 43. The orifice 62 is also located in the check piston 54, fluidly connected to low-pressure drain line segment A. In FIG. 4 second orifice 64 remains in the body 43, but as shown in FIG. 3 could also be located in the control valve 32.

INDUSTRIAL APPLICABILITY

High-pressure fuel enters the fuel injector through high-pressure fuel supply line 30. It travels to control valve 32 where in the non-energized state, the flow is blocked. At this condition, the injector is in a non-injection mode. High-pressure fuel supply line 30 is blocked and check line 44 is connected through control valve 32 to check control cavity line 58 and low-pressure drain line 60. It should be noted at this condition, both check line 44, fuel cavity 46, check control cavity line 58, and check control cavity 52 are all fluidly connected to low-pressure drain line 60 and subsequently to reservoir 10. When injection is desired, control valve 32 is actuated. Specifically, solenoid 34 is energized, thereby pulling up armature 36. As armature 36 pulls up, valve member 38 is pulled off of the lower seat 42. Those skilled in the art will recognize that the control valve could be equipped with a piezo-stack type actuator. As soon as the valve member 38 is pulled off the lower seat 42, high-pressure fuel from fuel supply line 30 is in fluid connection with check line 44 and check control cavity line 58 and low-pressure drain line 60. An orifice in low-pressure drain line 60 causes the flow to "back up" and move down check control cavity line 58 pressurizing check control cavity 52. At this stage, pressurized fuel exists in both fuel cavity 46 and check control cavity 52 and therefore the sum of the pressure and spring forces biases check valve 48 in the closed position.

Figure 6:
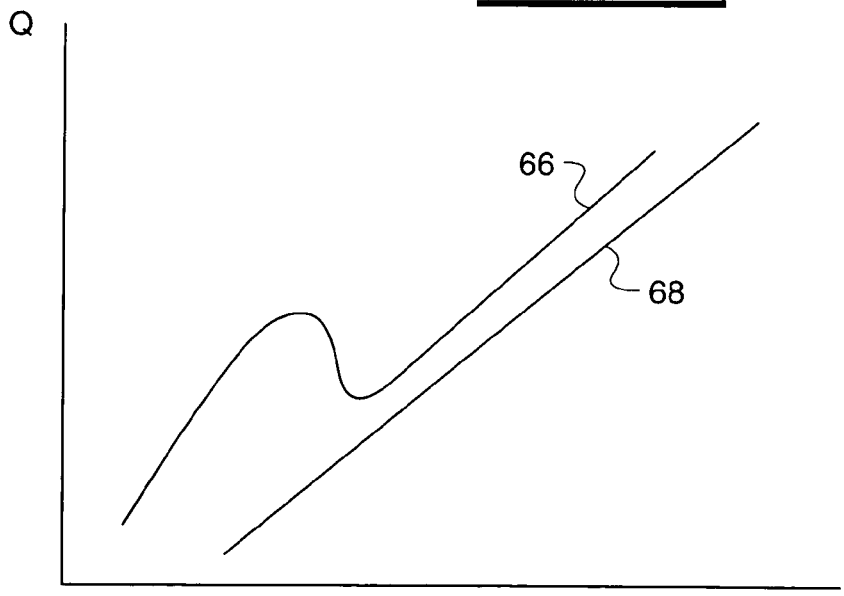
FIG. 6 is an example of a fuel delivery curve.

By keeping pressurized fuel in the check control cavity 52 while valve member 38 is between the seats, injection is prevented during this transitional phase. This provides better control of the fuel delivery curve (See FIG. 6). Typical common rail fuel injectors experience a decrease in fuel delivery as the valve member 38 hits the upper seat 40. Typically, the valve member 38 can bounce off the upper seat 40 for particular on-times (T) causing a reduction in fuel delivery and making injection predictability difficult, see standard fuel delivery curve 66. Ultimately, a specified range of the fuel delivery curve is deemed unusable, due to the lack of controllability, thereby eliminating efficiency of the injector. In the present case, the fuel injection does not occur until valve member 38 seats against the upper seat 40 due to the high-pressure flow entering check control cavity line 52 while the valve member is in transition, which provides a smoother second delivery curve 68. Once valve member 38 reaches the upper seat, pressurized fuel from high-pressure fuel supply line 30 is fluidly connected only to check line 44. Further, check control cavity 52 is allowed to drain to low-pressure drain line 60 thereby removing the pressure in check control cavity 52 and allowing fuel pressure in fuel cavity 46 to push check valve 48 up against check spring 50 and inject into the cylinder (not shown). It should be noted that orifice 62 provides a flow restriction in a low-pressure drain line 60. Low-pressure drain line 60 is always open to reservoir 10, therefore as soon as pressurized flow decreases enough that the flow can move through orifice 62, the pressure in check control cavity line 58 and check control cavity 52, can drain to low-pressure.

Once it is desirable to stop injection, control valve 32 is de-energized allowing armature 36 back down to its original position thereby moving valve member 38 from the upper seat 40 back down the lower seat 42. Once again during transition high-pressure fuel from fuel supply line 30 is fluidly connected to both the check line 44 and the check control cavity line 58 thereby providing a pressurized force in the check control cavity 52 to help close check valve 48. Furthermore, once valve member 38 reaches the lower seat 42 any remaining pressurized fuel in fuel cavity 46 and check line 44 is vented to the check control cavity line 58 thereby providing any residual pressure still existing in fuel cavity 46 to check control cavity 52 to help ensure quick closing of check 48. Finally pressure decreases in fuel cavity 46, check line 44, check control cavity 52 and check control cavity line 58 through orifice 62 to low-pressure through low-pressure drain line 60.

A second orifice 64 can be placed in the check control cavity line 58 to better control flow of pressurized fluid into check control cavity 52. As stated previously, second orifice 64 must be sized appropriately compared to orifice 62 in order to ensure that flow enters check control cavity 52 as opposed to going directly to reservoir 10 through low-pressure drain line 60.

The fuel injectors shown in FIG. 3 and FIG. 4 function in a similar manner to that described above, except that check control cavity 52 is allowed to drain through low-pressure drain line segment A 61*a* and low-pressure drain line segment B 61*b*, thereby removing the pressure in check control cavity 52 and allowing fuel pressure in fuel cavity 46 to push check valve 48 up against check spring 50 and inject fuel into the cylinder (not shown). Orifice 62 provides a flow restriction in low-pressure drain line segments 61*a* and 61*b*. Low-pressure drain line 60 is always open to reservoir 10, therefore as soon as pressurized flow decreases enough that the flow can move through orifice 62, the pressure in check control cavity line 58 and check control cavity 52, can drain to low-pressure. When stopping injection, after valve member 38 returns to the lower seat 42, any pressure remaining in fuel cavity 46, check line 44, check control cavity 52 and check control cavity line 58 exits through orifice 62 through low-pressure drain line segment A 61*a* and low-pressure drain line segment B 61*b*.

The above description is intended for illustrated purposes only and is not intended to limit the scope of the present invention in any way. Thus those who are skilled in the art will appreciate the various modifications can be made illustrated in the embodiment without departing from the spirit and the scope of the present invention, which is defined in the terms of the claims set forth below.

The invention claimed is:

1. A fuel injector comprising:

a high-pressure fuel supply line;

a fuel cavity;

a check control cavity;

a check valve at least partially disposed in said fuel cavity and being exposed to a fluid pressure force, in said check control cavity;

a control valve moveable between a first position, at which said high-pressure fuel supply line is fluidly connected to said fuel cavity and fluidly disconnected to said check control cavity, and a second position, at which said fuel cavity is fluidly connected to said check control cavity;

a low pressure drain line connected to said check control cavity;

a valve member at least partially disposed within said control valve; and an electrical actuator, being adapted to directly move said valve member.

2. The fuel injector of claim 1 wherein said control valve has a transition location between said first position and said second position in which said fuel cavity and said check control cavity are fluidly connected to said high-pressure fuel supply line; and a check control cavity line extending between said control valve and said check control cavity includes an orifice.

3. The fuel injector of claim 1 wherein said electrical actuator is a piezo-stack type actuator.

4. The fuel injector of claim 1 wherein said electrical actuator has an armature;

said armature being connected to said valve member.

5. The fuel injector of claim 1 further including:

a check piston having a predetermined diameter at least partially disposed in said check control cavity;

said check valve having a predetermined diameter; and said predetermined check piston diameter being greater than said predetermined check valve diameter.

6. A fuel injector comprising:

a high-pressure fuel supply line;

a fuel cavity;

a check control cavity;

a check valve at least partially disposed in said fuel cavity and being exposed to a fluid pressure force, in said check control cavity;

a control valve moveable between a first position, at which said high-pressure fuel supply line is fluidly connected to said fuel cavity, and a second position, at which said fuel cavity is fluidly connected to said check control cavity;

a low pressure drain line connected to said check control cavity;

a valve member at least partially disposed within said control valve;

an electrical actuator, being adapted to directly move said valve member; and said low-pressure drain line is directly connected to said check control cavity via an orifice disposed in a check piston.

7. A fuel injector comprising:

a high-pressure fuel supply line;

a fuel cavity;

a check control cavity;

a check valve at least partially disposed in said fuel cavity and being exposed to a fluid pressure force, in said check control cavity;

a control valve moveable between a first position, at which said high-pressure fuel supply line is fluidly connected to said fuel cavity, and a second position, at which said fuel cavity is fluidly connected to said check control cavity;

a low pressure drain line connected to said check control cavity;

a valve member at least partially disposed within said control valve;

an electrical actuator, being adapted to directly move said valve member; and a check piston at last partially disposed in said check control cavity, and said low-pressure drain line including an orifice disposed in said check piston.

8. A fuel injector comprising:

a high-pressure fuel supply line;

a fuel cavity;

a check control cavity;

a check valve at least partially disposed in said fuel cavity and being exposed to a fluid pressure force, in said check control cavity;

a control valve moveable between a first position, at which said high-pressure fuel supply line is fluidly connected to said fuel cavity, and a second position, at which said fuel cavity is fluidly connected to said check control cavity;

a low pressure drain line connected to said check control cavity;

a valve member at least partially disposed within said control valve;

an electrical actuator, being adapted to directly move said valve member;

an orifice in said low-pressure drain line; and a check control cavity line extending between said control valve and said check control cavity.

9. The fuel injector of claim 8 wherein said orifice is a first orifice; and check control cavity line includes a second orifice.

10. The fuel injector of claim 9 wherein said first orifice in said low-pressure drain line is smaller than said second orifice in said check control cavity line.

11. A fuel injector comprising:

a high-pressure fuel supply line;

a fuel cavity;

a check control cavity;

a check valve at least partially disposed in said fuel cavity and being exposed to a fluid pressure force, in said check control cavity;

a control valve moveable between a first position, at which said high-pressure fuel supply line is fluidly connected to said fuel cavity, and a second position, at which said fuel cavity is fluidly connected to said check control cavity;

a low pressure drain line connected to said check control cavity;

a valve member at least partially disposed within said control valve;

an electrical actuator, being adapted to directly move said valve member; and said fuel cavity is fluidly connected to said low pressure drain via said check control cavity when said control valve is in said second position.

12. A method of operating a fuel injector having a fuel cavity, a check control cavity, and a check valve at least partially, slideably disposed in said fuel cavity and exposable to a pressure force in said check control cavity, comprising:

actuating a control valve; and fluidly connecting said fuel cavity to said check control cavity; and stopping fuel injection by said fuel injector at least in part by fluidly connecting said fuel cavity to a low pressure drain line via said check control cavity.

13. The method of claim 12 including a step of restricting flow through the low pressure drain line with a first orifice; and restricting flow in a check control cavity line with a second orifice.

14. A method of operating a fuel injector having a fuel cavity, a check control cavity, a check valve at least partially, slideably disposed in said fuel cavity and exposable to a pressure force in said check control cavity, and a control valve moveable between a first position at which high-pressure fuel flows from a high-pressure fuel source to said fuel cavity and a second position at which said high-pressure fuel source is fluidly blocked from said fuel cavity, comprising:

moving said control valve from said second position to said first position through a transition location;

fluidly connecting said fuel cavity and said check control cavity to said high-pressure fuel source while said control valve is in said transition location;

fluidly connecting said check cavity to a low-pressure drain line via a first orifice; and restricting a fluid connection between said high-pressure fuel source and said check control cavity via a second orifice when said control valve is in said transition location.

15. The method of claim 14 further including:

maintaining said fluid connection between said fuel cavity and said high-pressure fuel source and fluidly blocking flow to said check control cavity when said control valve is in said first position.

16. The method of claim 14 wherein the moving step is accomplished by moving an armature attached to a valve member of the control valve.

17. The method of claim 14 including a step of stopping fuel injection by said fuel injector at least in part by fluidly connecting said fuel cavity to said low pressure drain via said first and second orifices.

* * * * *

UNITED STATES PATENT AND TRADEMARK OFFICE

CERTIFICATE OF CORRECTION

PATENT NO. : 7,278,593 B2
APPLICATION NO. : 10/600877
DATED : October 9, 2007
INVENTOR(S) : Wang et al.

It is certified that error appears in the above-identified patent and that said Letters Patent is hereby corrected as shown below:

In Column 6, Line 21, in Claim 1, delete "and fluidly disconnected" and insert -- but not fluidly connected --, therefor.

In Column 7, Line 22, in Claim 7, delete "at last" and insert -- at least --, therefor.

In Column 7, Line 48, in Claim 9, insert -- the --, before "check".

Signed and Sealed this

First Day of July, 2008

JON W. DUDAS
*Director of the United States Patent and Trademark Office*